US007607380B2

(12) United States Patent
Hiramatsu et al.

(10) Patent No.: US 7,607,380 B2
(45) Date of Patent: Oct. 27, 2009

(54) FLUID PRESSURE ACTUATOR

(75) Inventors: Kazuaki Hiramatsu, Ibaraki (JP); Taisuke Matsushita, Tokyo (JP); Yutaka Sato, Chiba (JP)

(73) Assignee: Kanda Tushin Kogyo Co., Ltd., Tokyo (JP)

( * ) Notice: Subject to any disclaimer, the term of this patent is extended or adjusted under 35 U.S.C. 154(b) by 487 days.

(21) Appl. No.: 10/578,350

(22) PCT Filed: Oct. 18, 2004

(86) PCT No.: PCT/JP2004/015365

§ 371 (c)(1),
(2), (4) Date: May 5, 2006

(87) PCT Pub. No.: WO2005/045259

PCT Pub. Date: May 19, 2005

(65) Prior Publication Data

US 2007/0084202 A1 Apr. 19, 2007

(51) Int. Cl.
*F01B 31/12* (2006.01)
*F01B 25/04* (2006.01)

(52) U.S. Cl. ..... 91/1

(58) Field of Classification Search ..... 91/1
See application file for complete search history.

(56) References Cited

U.S. PATENT DOCUMENTS

| | | | | |
|---|---|---|---|---|
| 4,279,192 | A * | 7/1981 | Kleinwaks | 91/361 |
| 4,744,218 | A * | 5/1988 | Edwards et al. | 91/361 |
| 4,860,639 | A | 8/1989 | Sakaguchi | |
| 5,697,285 | A | 12/1997 | Nappi et al. | |
| 6,202,539 | B1 * | 3/2001 | Feygin | 92/161 |
| 6,807,894 | B2 * | 10/2004 | Reininger | 92/5 R |

FOREIGN PATENT DOCUMENTS

| | | |
|---|---|---|
| JP | 57-037107 | 3/1982 |
| JP | 61-140603 | 6/1986 |
| JP | 61-157806 | 7/1986 |
| JP | 63-124840 | 5/1988 |
| JP | U 3-65002 | 6/1991 |
| JP | 06-117419 | 4/1994 |
| JP | 07-071406 | 3/1995 |
| JP | 08-026104 | 1/1996 |
| WO | WO 01/72479 | 10/2001 |

* cited by examiner

*Primary Examiner*—Daniel Lopez
(74) *Attorney, Agent, or Firm*—Antonelli, Terry, Stout & Kraus, LLP.

(57) ABSTRACT

A fluid pressure actuator includes: an actuator body which expands and contracts through supply/discharge of a fluid to generate a driving force; a sensor for detecting a condition of the actuator body; and a control part for controlling a fluid regulator for adjusting a pressure of the fluid supplied to and discharged from the actuator body based on a detection signal from the sensor. The sensor is mounted in the actuator body.

14 Claims, 5 Drawing Sheets

FLUID PRESSURE ACTUATOR

TECHNICAL FIELD

The present invention relates to a fluid pressure actuator driven through supply and discharge of a fluid, such as air.

BACKGROUND ART

For example, JP 2002-103270 A proposes a driving device which moves joints of a robot or a human body by tube-type air actuators. Tube-type air actuators are actuators which are reduced in length through supply of air to generate a driving force (tensile force). The supply and discharge of air to and from the tube-type air actuator are effected by an air supply/discharge portion. The air supply/discharge portion is controlled by a control part.

DISCLOSURE OF THE INVENTION

Problem to be Solved by the Invention

However, in conventional tube-type air actuators, only the pressure of the air supplied from the air supply/discharge portion is controlled by the control part, so, in a driving device formed by using a tube-type air actuator, it is impossible to control the driving force generated and the actuator length with sufficient accuracy.

The present invention has been made with a view toward solving the above-mentioned problem. It is an object of the present invention to provide a fluid pressure actuator which is capable of accurately controlling the driving force generated and the actuator length.

Means for Solving the Problem

A fluid pressure actuator according to the present invention includes: an actuator body which expands and contracts through supply/discharge of a fluid to generate a driving force; a sensor for detecting a condition of the actuator body; and a control part for controlling a fluid regulator for adjusting a pressure of the fluid supplied to and discharged from the actuator body based on a detection signal from the sensor. The sensor is mounted in the actuator body.

BEST MODE FOR CARRYING OUT THE INVENTION

Hereinafter, the best mode for carrying out the present invention will be described with reference to the drawings.

EMBODIMENT 1

Figure 1:
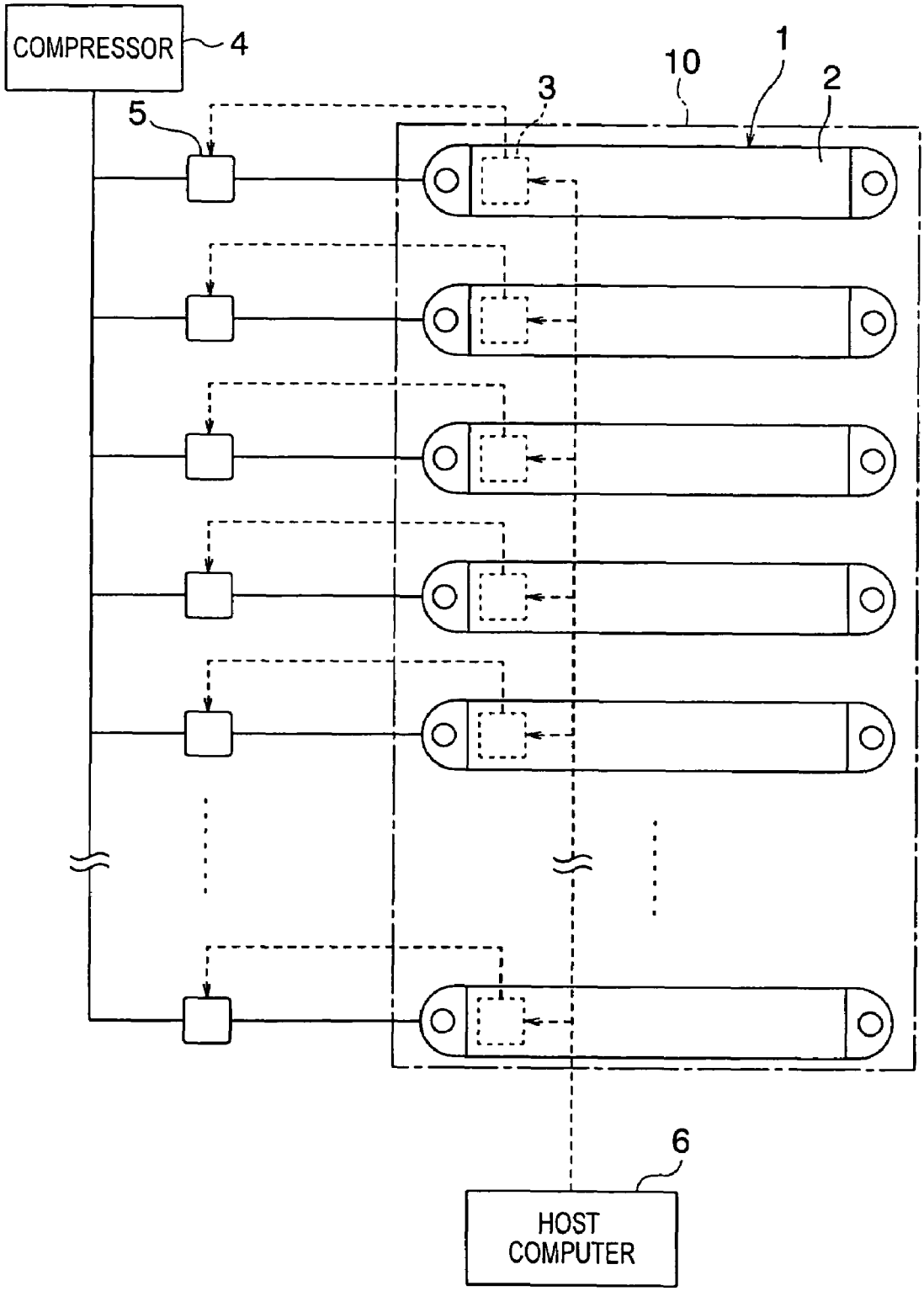
FIG. 1 is a schematic view of an air actuator system according to Embodiment 1 of this invention.

FIG. 1 is a schematic view of an air actuator system according to Embodiment 1 of this invention. In this example, there is shown an air actuator system which is attached to a human body to move joints of the human body. In the figure, an attachment portion 10 to be attached to the human body is provided with a plurality of tube-type air actuators 1 as fluid pressure actuators (pneumatic actuators).

Each tube-type air actuator 1 has an actuator body 2 and a circuit board 3 contained within the actuator body 2. Each actuator body 2 has a rubber tube (not shown) and a net-like sleeve (not shown) covering the outer periphery of this rubber tube. The actuator body 2 is reduced and increased in length through supply and discharge of air. That is, the actuator body 2 expands through supply of air, and is reduced in length. When the actuator body 2 thus contracts, a driving force (tensile force) is generated.

Air is supplied to each actuator body 2 from a common compressor 4. Between the compressor 4 and the actuator bodies 2, there are provided electropneumatic regulators 5 as fluid regulators for adjusting the pressure of the air supplied to and discharged from the actuator bodies 2. A command signal from the corresponding circuit board 3 of the tube-type air actuator 1 is input to each electropneumatic regulator 5. Further, a command signal from a host computer 6 is input to each circuit board 3.

Figure 2:
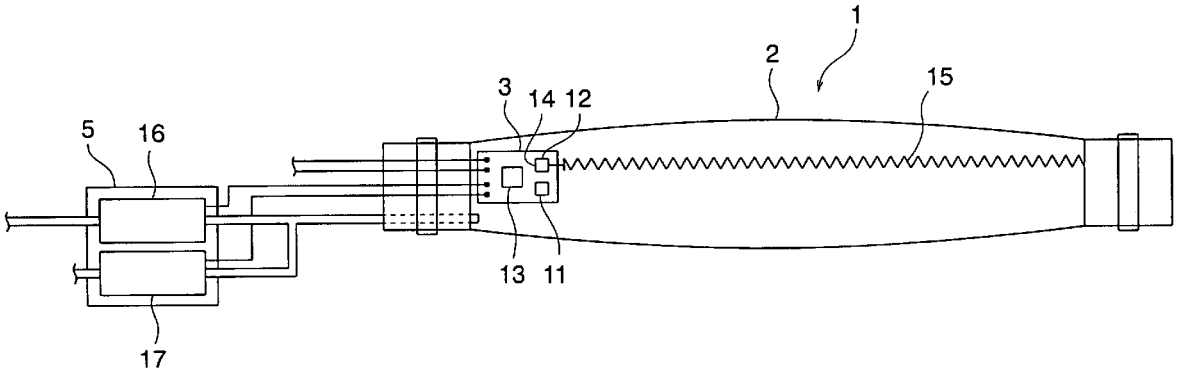
FIG. 2 is an enlarged schematic view of a main portion of FIG. 1.

FIG. 2 is an enlarged schematic view of a main portion of FIG. 1. In FIG. 2, the circuit board 3 is equipped with a pressure sensor 11 for detecting the pressure in the actuator body 2, a length sensor 12 for detecting the length of the actuator body 2, and a control part 13 for controlling the electropneumatic regulator 5 based on detection signals from the pressure sensor 11 and the length sensor 12. The circuit board 3 is mounted on the actuator body 2 such that the pressure sensor 11 and length sensor 12 face the interior of the actuator body 2. As the circuit board 3, an HIC (hybrid IC) may be used. Further, the circuit board 3 is formed such that it can withstand the maximum pressure (e.g., 0.7 MPa) within the actuator body 2.

The length sensor 12 has a sensor body 14 and a length measurement spring 15 connected between the sensor body 14 and the actuator body 2. As the length measurement spring 15, there is used a weak tensile spring which is weak to a degree that it does not interfere with the expansion and contraction of the actuator body 2. As the sensor body 14, there is used a tensile sensor (tensile load sensor). Further, as the tensile sensor, a pressure sensor may be used which differs in characteristics from the pressure sensor 11.

In a state in which the air in the actuator body 2 has been discharged, a weak tensile force due to the length measurement spring 15 is acting on the actuator body 2. When, in this state, air is supplied into the actuator body 2, the length of the actuator body 2 is reduced, and the tensile force due to the length measurement spring 15 becomes still smaller. By detecting this change in tensile force by the sensor body 14, it is possible to measure the length of the actuator body 2 from the relationship of $F=kx$ (where F: spring force, k: spring modulus, and x: spring length).

Information on the pressure in the actuator body 2 detected by the pressure sensor 11 and information on the length of the actuator body 2 detected by the length sensor 12 are fed back to the control part 13. These items of information may be fed back to the host computer 6 as needed. The control part 13 controls the electropneumatic regulator 5 according to the information fed back and a command signal from the host computer 6.

The electropneumatic regulator 5 has an air-supply proportional control valve 16 and an exhaust proportional control valve 17. Proportional electromagnetic valves are used as the air-supply proportional control valve 16 and the exhaust proportional control valve 17. When an electric current is caused to flow through a coil within a proportional electromagnetic valve, the proportional electromagnetic valve causes air to flow with a flow rate according to the value of the electric current. The air-supply proportional control valve 16 and the exhaust proportional control valve 17 are controlled by command signals from the control part 13.

Figure 3:
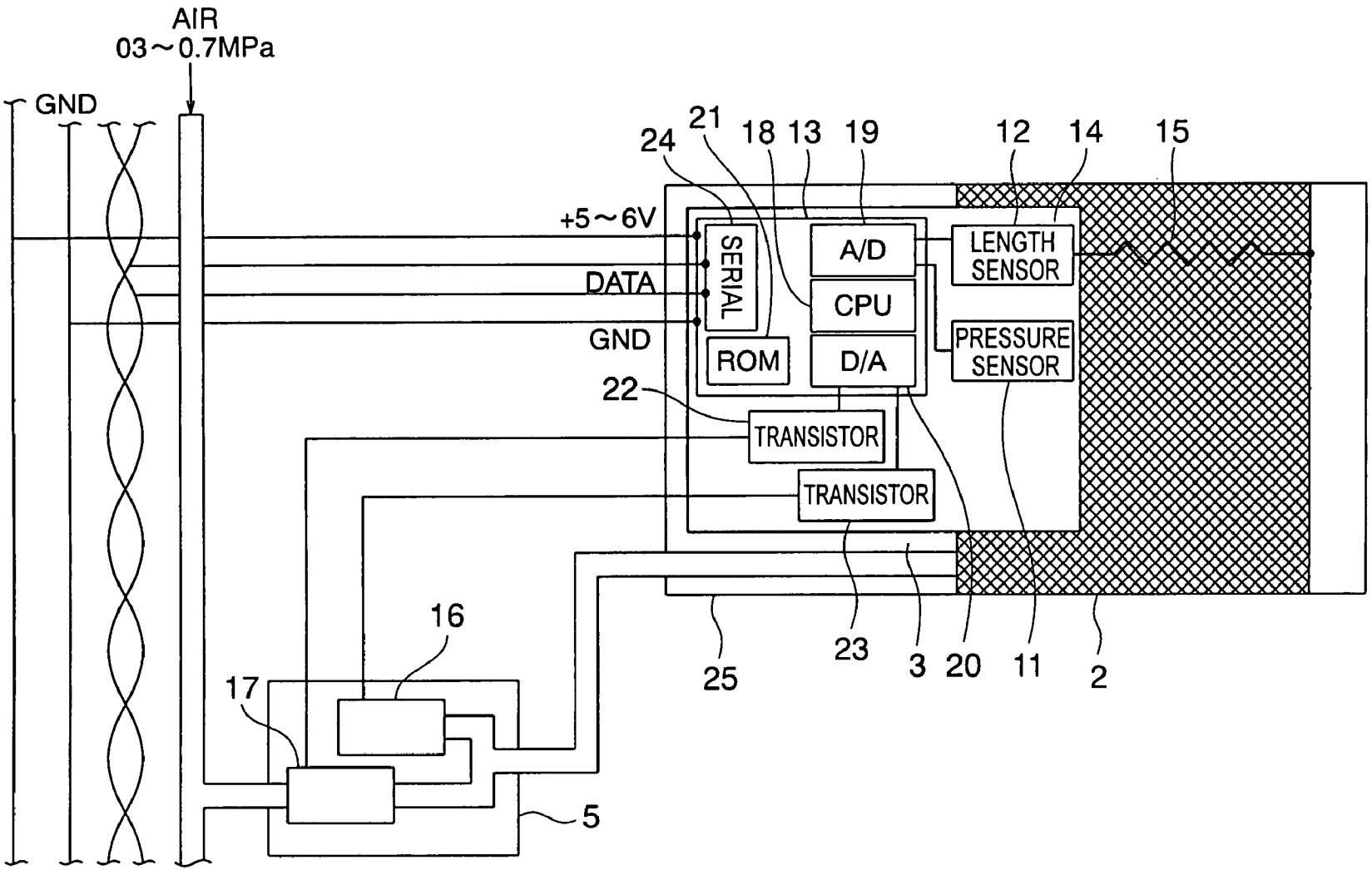
FIG. 3 is a schematic view showing more specifically a circuit board of FIG. 2.

FIG. 3 is a schematic view showing more specifically the circuit board 3 of FIG. 2. The control part 13 has a CPU 18 serving as processing means, an A/D converter 19, a D/A converter 20, a ROM 21 serving as storage means, a transistor 22 serving as an air-supply side current amplifier, a transistor 23 serving as an exhaust side current amplifier, and a serial I/O port 24. The ROM 21 stores an address (ID information) specific to the tube-type air actuator 1 on which the control part 13 is mounted. Further, the ROM 21 stores a program for controlling the electropneumatic regulator 5, a program for communication with the host computer 6, etc. The control part 13 is connected to the host computer 6 through the serial I/O port 24. Of the pressure control signals from the host computer 6, only a signal of the corresponding address undergoes an arithmetic operation at the CPU 18.

The signals from the pressure sensor 11 and the length sensor 12 are A/D-converted by the A/D converter 19 and are input to the CPU 18. The CPU 18 generates and outputs a command signal such that the output pressure of the electropneumatic regulator 5 becomes a target pressure according to a pressure control signal. This command signal is D/A-converted by the D/A converter 20, and is output to the air-supply proportional control valve 16 and the exhaust proportional control valve 17 through the transistors 22 and 23.

An end sealing member (rubber stopper) 25 is fixed to one end of the actuator body 2. An air supply/discharge tube connecting the electropneumatic regulator 5 and the actuator body 2 is inserted into the actuator body 2 through the end sealing member 25. By way of example, a part of the circuit board 3 is embedded in the end sealing member 25 for fixation. Electrical wiring (a signal line, a power line, etc.) connected to the circuit board 3 is led out to the exterior of the actuator body 2 through the end sealing member 25.

Figure 4:
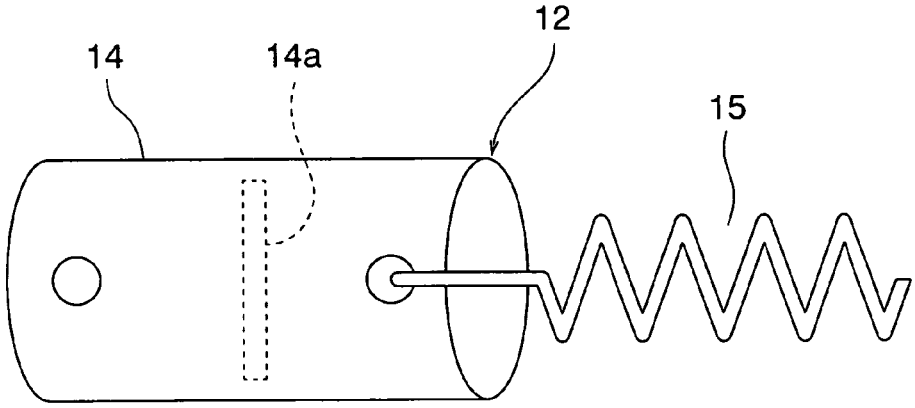
FIG. 4 is a schematic view of a first example of a length sensor of FIG. 2.
Figure 5:
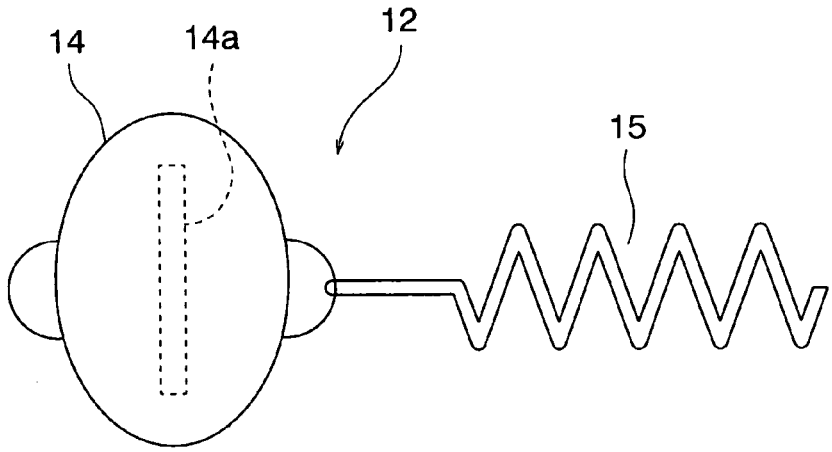
FIG. 5 is a schematic view of a second example of the length sensor of FIG. 2.
Figure 6:
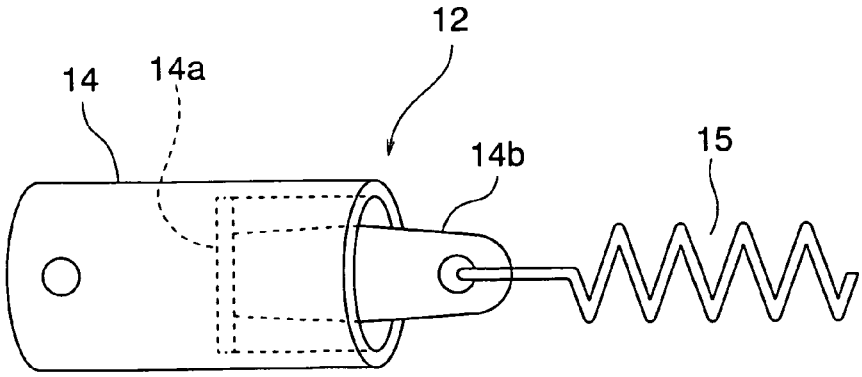
FIG. 6 is a schematic view of a third example of the length sensor of FIG. 2.

FIG. 4 is a schematic view showing a first example of the length sensor 12 of FIG. 2, FIG. 5 is a schematic view showing a second example of the length sensor 12 of FIG. 2, and FIG. 6 is a schematic view showing a third example of the length sensor 12 of FIG. 2. In the first example, a sensor element (piezoelectric element) 14*a* is embedded in a columnar sensor body 14. In the second example, the sensor element 14*a* is embedded in an ellipsoidal-ball like sensor body 14. In the third example, the sensor element 14*a* is arranged within a cylindrical sensor body 14, and the length measurement spring 15 is connected to the sensor element 14*a* through a connecting member 14*b* inserted into the sensor body 14.

In such tube-type air actuator 1, the pressure sensor 11 is arranged inside the actuator body 2, so it is possible to directly detect the pressure in the actuator body 2 without using any air piping, and the influence of the load, pressure loss, etc. is mitigated, making it possible to detect the pressure in the actuator body 2 more accurately even in a dynamic state. As a result, it is possible to control the generated driving force more accurately.

Further, the length sensor 12 is arranged inside the actuator body 2, so, even if the object of control is deviated in position due to fluctuations in the load, it is possible to grasp the length of the actuator body 2 more accurately, making it possible to control the actuator length more accurately.

Further, the pressure sensor 11, the length sensor 12, and the control part 13 are provided on the common circuit board 3, so it is possible to perform analysis and arithmetic operation on the information regarding the condition of itself by means of the control part 13 independently of the load and the situation of use, making it possible to grasp information on the condition of the object of control more accurately and to perform a more intelligent control on the tube-type air actuator 1. Further, since the distance from the pressure sensor 11 and the length sensor 12 to the control part 13 is short, it is possible to prevent a delay in control timing and to perform control at higher speed.

Furthermore, as shown in FIG. 3, the circuit board 3 is provided on the end sealing member 5 in which the air supply/discharge port for the actuator body 2 is formed. As a result, it is possible to reduce the length of the connection wiring connecting the sensors 11, 12 on the circuit board 3 to the air-supply proportional control valve 16 and the exhaust proportional control valve 17.

EMBODIMENT 2

Figure 7:
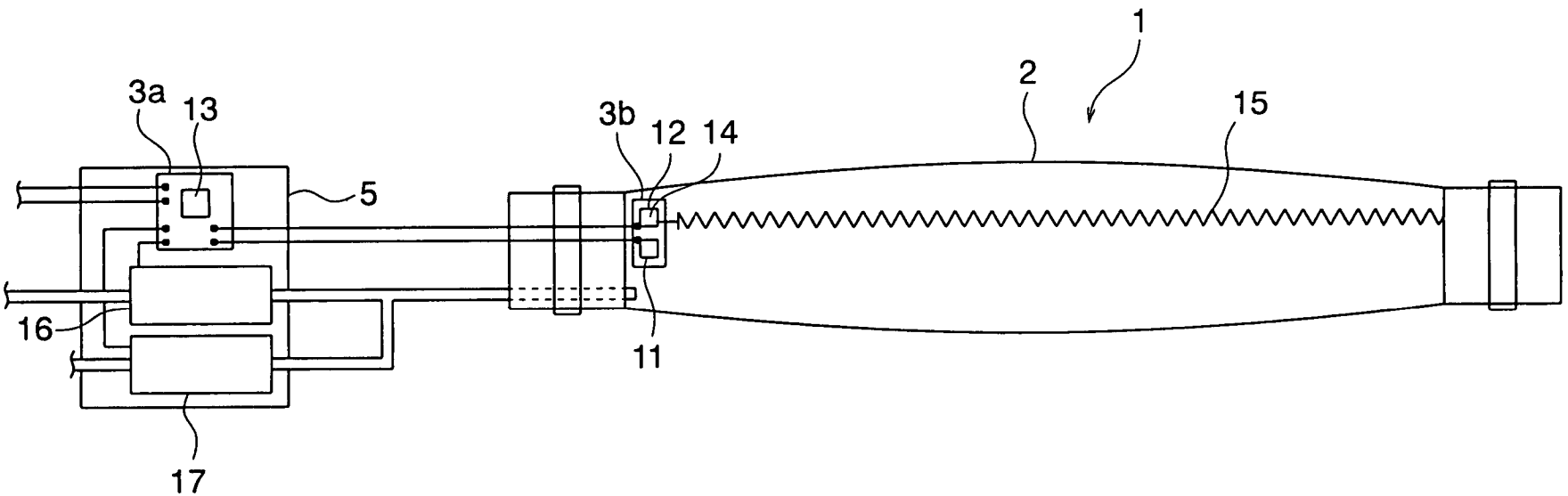
FIG. 7 is a schematic view of a tube-type air actuator according to Embodiment 2 of this invention.

Next, FIG. 7 is a schematic view showing a tube-type air actuator according to Embodiment 2 of this invention. While in Embodiment 1 the circuit board 3 with the control part 13 mounted thereon is arranged in the actuator body 2, in Embodiment 2, a circuit board 3*a* with the control part 13 mounted thereon is provided on the electropneumatic regulator 5. A substrate 3*b* with the pressure sensor 11 and the length sensor 12 mounted thereon is arranged inside the actuator body 2.

In this way, it is also possible to separate the pressure sensor 11 and the length sensor 12 from the control part 13 to arrange only the sensors 11, 12 in the actuator body 2.

While in Embodiments 1 and 2, the pressure sensor 11 and the length sensor 12 are formed as separate components, it is also possible to integrally structure them by embedding the sensor element of the pressure sensor and the sensor element of the length sensor in a common body.

Further, while in Embodiment 1 the circuit board 3 is directly fixed to the end sealing member 25, it is also possible to connect the actuator body 2 and the circuit board 3 through a rigid body.

Further, the transmission and reception of signals between the circuit boards 3 and the host computer 6 may be effected through serial communication (with wiring omitted) or by radio.

Furthermore, while in Embodiments 1 and 2 the tube-type air actuator 1 is used as the fluid pressure actuator, it is also possible to adopt a fluid pressure actuator of some other configuration and system.

Further, while in the above embodiments the fluid is air, the fluid may be a gas other than air, or a liquid such as oil.

Further, the fluid pressure actuator of the present invention is applicable not only to the driving of joints but also to all possible uses.

Furthermore, while in Embodiments 1 and 2 a pressure sensor and a length sensor are used as the sensors, the sensors are not restricted thereto.

The invention claimed is:

1. A fluid pressure actuator comprising:

an actuator body which expands and contracts through supply/discharge of a fluid to generate a driving force;

a sensor for detecting a condition of the actuator body; and a control part for controlling a fluid regulator for adjusting a pressure of the fluid supplied to and discharged from the actuator body based on a detection signal from the sensor;

wherein the sensor is mounted in the actuator body; and wherein the sensor and the control part are provided on a common circuit board, and the circuit board is mounted on the actuator body so that the sensor faces the interior of the actuator body.

2. The fluid pressure actuator according to claim 1, wherein the sensor is a pressure sensor for detecting the pressure in the actuator body.

3. The fluid pressure actuator according to claim 1, wherein the sensor is a length sensor for detecting the length of the actuator body.

4. The fluid pressure actuator according to claim 3, wherein the length sensor has a sensor body and a length measurement spring connected between the sensor body and the actuator body, and the sensor body detects a change in a tensile force due to the length measurement spring.

5. The fluid pressure actuator according to claim 1, wherein both a pressure sensor for detecting a pressure in the actuator body and a length sensor for detecting a length of the actuator body are mounted in the actuator body as the sensor.

6. The fluid pressure actuator according to any one of claims 1 through 5, wherein the circuit board is formed by a hybrid IC.

7. The fluid pressure actuator according to any one of claims 1 through 5, wherein an end sealing member is fixed to one end of the actuator body, and the circuit board is fixed to the end sealing member.

8. The fluid pressure actuator according to any one of claims 1 through 5, wherein the control part controls the fluid regulator based on a pressure control signal from a host computer and a detection signal from the sensor.

9. The fluid pressure actuator according to claim 8, wherein the control part has processing means for generating a command signal so that an output pressure of the fluid regulator becomes a target pressure according to the pressure control signal.

10. The fluid pressure actuator according to claim 9, wherein the processing means is a CPU, and the control part has an A/D converter for A/D-converting the detection signal from the sensor and inputting the A/D converted detection signal to the CPU, and a D/A converter for D/A-converting the command signal from the CPU and outputting the D/A converted command signal to the fluid regulator.

11. The fluid pressure actuator according to claim 8, wherein the control part has an I/O port receiving a pressure control signal from the host computer.

12. The fluid pressure actuator according to claim 1, wherein the control part has storage means storing specific addresses, and of pressure control signals received from a host computer, only a signal of a corresponding address is processed by the control part.

13. The fluid pressure actuator according to claim 8, wherein the control part has storage means storing a program for communication with the host computer.

14. The fluid pressure actuator according to any one of claims 1 through 5, wherein the control part is provided on the fluid regulator.

* * * * *